US005242547A

United States Patent [19]

Corbellini et al.

[11] Patent Number: 5,242,547

[45] Date of Patent: Sep. 7, 1993

[54] SUBMERGED DRAINAGE SYSTEM FOR FORMING AND DEWATERING A WEB ON A FOURDRINIER FABRIC

[76] Inventors: Glauco Corbellini, 33100 Via Carducci 48, Udine, Italy; Peter A. Rodriguez, 1785 Selva Marina, Atlantic Beach, Fla. 32233

[21] Appl. No.: 717,880

[22] Filed: Jun. 17, 1991

Related U.S. Application Data

[63] Continuation of Ser. No. 384,744, Jul. 24, 1989, abandoned.

[51] Int. Cl.[5] ..... D21F 1/48

[52] U.S. Cl. ..... 162/351; 162/352; 162/364

[58] Field of Search ..... 162/301, 351, 352, 363, 162/364, 211, 217

[56] References Cited

U.S. PATENT DOCUMENTS

| | | | |
|---|---|---|---|
| 2,893,486 | 7/1959 | Marti | 162/364 |
| 3,507,746 | 4/1970 | Rhine | 162/363 |
| 3,595,744 | 7/1971 | Skoldvist | 162/301 |
| 3,823,062 | 7/1974 | Ward et al. | 162/301 |
| 4,306,934 | 12/1981 | Seppanen | 162/217 |
| 4,895,623 | 1/1990 | Corbellini | 162/217 |

*Primary Examiner*—Karen M. Hastings
*Attorney, Agent, or Firm*—Arthur G. Yeager

[57] ABSTRACT

Improved system for controlling the forming and dewatering of a web of paper by submerged drainage in which air does not penetrate the fiber/aqueous dispersion and the formed web. The dewatering is via altering the natural tension of the meniscus of the water to induce enhanced drainage of water from the aqueous dispersion of paper making fibers in the wetter end of the system and from the drier end of the fabric. Also, the improved horizontal system provides substantially equivalent side surfaces to the paper formed in such system.

13 Claims, 7 Drawing Sheets

SUBMERGED DRAINAGE SYSTEM FOR FORMING AND DEWATERING A WEB ON A FOURDRINIER FABRIC

This is a continuation of copending application(s) Ser. No. 07/384,744 filed on Jul. 24, 1989, now abandoned.

BACKGROUND OF THE INVENTION

Modern paper making processes and machinery follow the Fourdrinier method wherein an aqueous dispersion of paper making fibers is poured onto a high speed travelling woven fabric through which water from the dispersion drains leaving a thin web of wet fibers which is dried and finished to a sheet of paper. The key step in this method is that of forming the web from the fiber/aqueous dispersion. This must be done very quickly and uniformly across the width of the endless fabric. Normally, the transition of dewatering commences by gravity, followed by other means such as foil blades, continuing with a plurality of controlled low vacuum boxes and then by a plurality of high vacuum boxes. There are many causes for mishaps to occur that prevent the final sheet of paper from being perfect. One of the principal causes is that air may penetrate the web of paper and the fabric causing nonuniformities in the paper. Such disturbances may be caused by nonuniform drainage at every square inch of the fabric surface, and entrainment of air in the fiber/aqueous dispersion followed by forcing air through the dispersion and fabric whereby air will find the path of least resistance and fixing the fluctuation of such dispersion unevenly over the fabric. The demand for higher and higher speed makes it increasingly difficult to produce a paper sheet that is isotropic.

The critical step of this process is the water removal, which must be done quickly and uniformly in order to obtain a layer of fibers on the fabric that can be finished to a high quality paper. The principal difficulty in producing a fast, uniform drainage has been that when the drainage is speeded up by applying a vacuum there are numerous instances at random locations across the fabric where air will be pulled through the layer of wet fibers. At each location a small vortex appears to break the continuity of the film of water and fiber on the fabric, and to permit the passage of air through the entire film and thereby disrupting the uniform settling of the fibers into a web of uniform thickness and strength. Every time such an instance occurs, a meniscus is formed at the interface of the water and air and this is an obstruction to the free uniform flow of water away from the fibers forming the web. The formation of such air holes through the mass of fibers forming the web must be minimized if any improvement in sheet formation at high speed is to be achieved.

It is an object of this invention to provide improved sheet formation in the Fourdrinier paper making process. It is another object of this invention to provide an improved procedure for maintaining a continuous drainage of water with substantially no air flow discontinuities occurring in the forming web. It is an object of this invention to provide a drainage process wherein all of the web forming fibers are essentially submerged in water until the last moment when the last portion of water is drained away from all parts of the web simultaneously. A further object is to improve the drainage while maintaining a higher retention of fines and fillers in the web than heretobefore accomplished. For example, the prior art mills may have a first pass retention of between 40–60 percent whereas this invention provides first pass retention of up to 90%. Another object is to decrease the amount of friction between the fabric and the dewatering components to increase the fabric life. A further object is to substantially reduce the length of the forming area of the Fourdrinier fabric, thereby reducing the number of dewatering components required. For example, one submerged drainage box in accord with this invention may replace 20–25 foils of the prior art and in substantially less space along the length of the fabric. An additional object is to improve the sheet formation by decreasing its porosity and substantially eliminating pin holes through the sheet. Another object is to decrease the power consumption of the Fourdrinier machine in both driving the fabric and by eliminating high vacuum pumps to supply suction to the dry end flat boxes thereof.

Yet other objects include:

A. retention of more chemical additives and fines due to the more gentle dewatering and uniformity of dewatering;

B. easier release of web from the fabric due to the web not being forced into the interstices of the fabric by high vacuum whereby a web pick-up vacuum roll or high pressure air from below the fabric not needed;

C. amount of defoamer is reduced;

D. enhanced sheet strength; and

E. enhanced drying at the drier end of the fabric (couch roll) thus reducing the power used in the press and/or the drying sections. Still other objects will appear from the more detailed description which follows.

BRIEF SUMMARY OF THE INVENTION

These definitions may be used in understanding this invention

A. Meniscus is the surface area of a water volume which is in contact with unlike surfaces. The unlike surfaces being either the container holding the water or the gases in contact with a surface of the water or surrounding the water, such as air when a drop of water is falling through it. *Webster's New International Dictionary, 2nd Edition, Unabridged,* 1934 defines Meniscus as—the curved upper surface of a liquid column that is concave when the containing walls are wetted by the liquid and convex when not. However, the meniscus also is present at the interface between the liquid and the vessel in which it is contained.

B. Surface Tension is a condition that exists at the free surface film of a liquid by reason of intermolecular forces about the individual surface molecules and is manifested by properties resembling those of an elastic skin under tension. Surface Tension is a characteristic of the water meniscus which can be modified by chemical means. The meniscus changes its geometric (concave) shape depending on the size of the vessel containing the fluid. In capillary tubes the meniscus reaches extremely high levels of energy in the form of pressure. The resistance of the meniscus to rupture, compared to it's thickness is very high as is well known.

C. Draining by eliminating the meniscus, or submerged drainage, is a water removal operation whereby water is removed from the aqueous dispersion or wet web by means of a reduction of pressure originating from, and transmitted by the water and not by the prior art vacuum as may be provided in the wet and drier end of a Fourdrinier fabric. In particular, the meniscus is eliminated in the surface of the fabric opposite to the pulp or web so that drainage is unimpeded.

This invention relates to a submerged drainage system for removing water from a moving Fourdrinier fabric having a drier end downstream of a wetter end, an outer surface, and an inner surface in a paper making process. The improved system includes a first plurality of spaced elongated stationary dewatering meniscus tension units each having a bottom and an upper drainage surface in continuous sliding contact with the inner surface and an aqueous dispersion of paper making fibers supported on the outer surface. The dewatering meniscus tension units are spaced along the wetter end of the fabric and each has an internal space for containing a volume of water extending to and in contact with the inner surface of the fabric. A plurality of passageways are provided from the drainage surface to the internal space of the unit to conduct water from the outer to the inner surface of the fabric to the internal space of the unit. A first passageway conducts water from the space by gravity outwardly of the unit. A means for applying a low vacuum by means of a far to the volume of water within the internal space induces the control of enhanced drainage of water from the aqueous dispersion.

An important aspect of this invention includes means for maintaining the level of water of the internal space of the drainage box constantly in contact with the inner surface of the fabric to inhibit the formation of an air water meniscus from being between said inner surface of the fabric and the upper drainage surface of the unit.

Another important aspect the system further includes is a second plurality of spaced elongated stationary, multicell drainage units or boxes along the drier end of the fabric and having a surface in continuous contact with the inner surface. A web is formed prior to the drier end from the aqueous dispersion of paper making fibers supported on the outer surface above the boxes, each multicell drainage unit or box including a plurality of cells each having an internal space placed under subatmospheric pressure by a fan means for each cell extending to and in contact with the inner surface of the fabric. A first passageway conducts air from outside the box to the drainage surface of the box and the inner surface of the fabric, and a second passageway communicates from the drainage surface of the box to the internal space of the box and the first passageway through the interstices of the fabric. A second means applies a small vacuum to the internal space to modify the natural tension of the meniscus of the water in the fabric to induce drainage of water from the web to the fabric and the box. Also, a means is provided to discharge the water from the internal space of the box.

In other aspects there is provided a means for applying a vacuum which may include a vertical head of water having an upper surface with air under subatmospheric pressure above such surface of the head of water. A means to control and maintain constant the level of water in the internal spaces of the first dewatering meniscus units is provided. The first passageway of each unit includes an exit conduit for water to flow out of such dewatering meniscus tension unit, and a movable valve to open and close the conduit. A float may e placed on the surface of the vertical head of water, and means to sense the position of the float or the pressure of the volume of water in the unit, and correspondingly to move the valve to open or close same in accordance with its position so sensed, may be located adjacent the float. This is accomplished in one embodiment by a source of electrical and fluid power and in another preferred embodiment by mechanical and fluid power.

In specific and preferred embodiments of this invention the upper surface of a volume of water is in contact with the Fourdrinier fabric as it passes by, and water is removed from the aqueous dispersion of paper making fibers resting on the fabric by controlling the outflow of water from that volume so as to produce a differential pressure, as by it flowing into a tray at the box bottom and outwardly therefrom. In another embodiment a vacuum over a vertical column of water is controlled so as to cause a suction to be applied to the volume of water to place the meniscus of water in a pretension condition to cause contact with and withdrawal of water from the aqueous dispersion. In still another embodiment water removal is effected in two directions from the dispersion by employing two Fourdrinier fabrics, one above and one below the dispersion, and causing water to flow out through both fabrics.

In further aspects each box includes a plurality of spaced parallel blades with a forward area in contact with the fabric and a rearward area being relieved to enhance dewatering of the dispersion on the fabric thereabove. Air suction tubes may be spaced along the length of the box to remove air and water entrained in the water in the fabric and therebelow. Such tubes are connected to an exhaust fan and a water discharge leg is connected therebetween to discharge water into the outflow of water from the boxes.

Additional aspects are provided by each cell having a nose with a horizontal planar surface over which the inner surface of the fabric slides. The first passageway is at an acute angle with the planar surface to conduct air into the inner surface of the fabric in the same direction as the movement of the fabric. The second passageway is at an acute angle with the planar surface to conduct air and water away from the inner surface of the fabric into the internal space thereby minimizing any air being passed through the web. A source of steam preferably is used to heat the air passing through the first passageway to enhance water drainage from the web.

The invention herein is also seen to include a method of removing water from an aqueous fiber dispersion supported on the fabric including sequentially passing the fabric and the dispersion over and in contact with an upper level of a volume of water enclosed on all sides except for the side in contact with the fabric removing water from the volume of water at a level below the upper level to produce a differential pressure effect on the volume of water; controlling the removal of water and the differential pressure effect to achieve an optimum dewatering of the dispersion uniformly over the fabric as it passes over the volume of water; and recovering a wet web of paper on the fabric suitable for pressing, drying and finishing to a sheet of paper. The above controlling may be automatic and include sensing the rise and fall of the pressure of the water in the box; and increasing and decreasing respectively the removal of water according t the sensed rise and fall of the pressure in the water volume in the box. Also, the method preferably includes removing water and entrained air from the dispersion and/or from the fabric followed by separating the air and the water so removed for separate treatment of each.

The invention also includes a method of removing water from an aqueous fiber dispersion formed into a wet web including passing the fabric and wet web of fibers over and in contact with a submerged drainage removal means; applying a small vacuum to the removal means to extract water and air from the fabric and modifying consequently the natural tension of the meniscus of the water in the fabric to extract water from the wet fabric; and permitting air from the atmosphere to be applied to the removal means and thence to the fabric from below the fabric to enhance the removal of water from the fabric and water from the web. The air introduced upstream from the vacuum whereby the air travels in the same direction as and in the interstices of the fabric and enhances the removal of water from the web. Steam also may be applied to further enhance water removal from the web. This method may also include supplying another fabric on the wet web moving in the same direction as the fabric. The aforementioned steps of passing, applying, and permitting are applied above the other fabric with the same effective results to produce a paper web and sheet therefrom having substantially the same characteristics on each planar surface thereof.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

On the surface of the Fourdrinier fabric the meniscus infiltrates the interstices or meshes and produces several phenomena, one being that while a dry fabric is easily penetrated by air, the same fabric, when wet, will be difficult to penetrate by air and yet easily penetrated by the water. Since the film of the meniscus attaches to the fabric, it allows the passage of water, the meniscus itself being water. However, before air can pass through the fabric the meniscus layer must first be ruptured by a certain level of air pressure considered here as tension of the meniscus of water.

The features of this invention are best understood by reference to the attached drawings.

Figure 1:
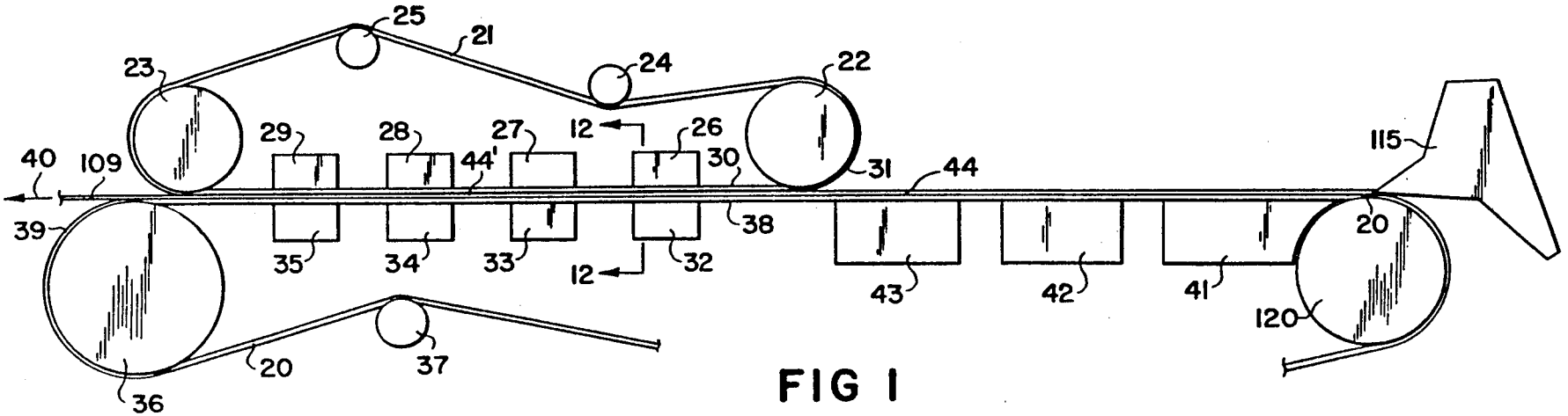
FIG. 1 is an overall schematic side elevational view of the system of this invention using two Fourdrinier fabrics.

A Fourdrinier paper making machine of the prior art is somewhat similar to the lower half of the apparatus of FIG. 1 wherein a woven fabric 20 travels horizontally in the direction of arrow 40 and passing over the top of several devices in locations such as those shown at 41, 42, 43, 32, 33, 34 and 35 to remove water from a layer of a fiber/aqueous dispersion 44 fed to the top of fabric 20 by a head box 115 and to leave a self supporting web of wet fiber at 109 which can be taken from the fabric 20 and processed through drying, pressing, and finishing operations to become a sheet of paper. The water removal devices of the prior art are normally boxes with a top cover of approximately 40–50% open area over which fabric 20 passes and with the interior of the box at subatmospheric pressure so as to suck water and/or air through the fabric 20 into the box for additional water removal. Generally, such boxes are fashioned with a plurality of parallel slots and/or holes and blades or foils, which are inclined against the direction of movement 40 of fabric 20 so as to cause water beneath the fabric to flow more readily through and away from the fabric 20. The purpose of such action is to essentially wipe away any bubble or any drops or hanging water below the bottom of fabric 20 and thereby seeking to maintain a flow of water draining out of the dispersion on the top of fabric 20 against the resistance formed by the meniscus of water attached along the interstices of the fabric.

It is an important feature of this invention to eliminate, to the maximum extent possible, the opportunities for the water to form bubbles or meniscus, and thereby to keep the water drainage flowing as rapidly and uninterrupted as possible. The guiding principle for the improved system of this invention is maintaining an uninterrupted continuous volume of water from fabric 20 to a place of discharge of the water drained from the fabric 20 while maintaining a negative pressure differential, i.e., a small vacuum, on the water at the fabric 20. This general system is now known as "submerged drainage" because the objective is to prevent any interfaces of water and air or other surfaces which form a meniscus and which seriously impede the rapid drainage of water. Of course, it is not possible to be perfect in preventing the formation of meniscus and so the system must also provide means for destroying any meniscus as soon as it is formed so as to resume "submerged drainage".

Figure 2:
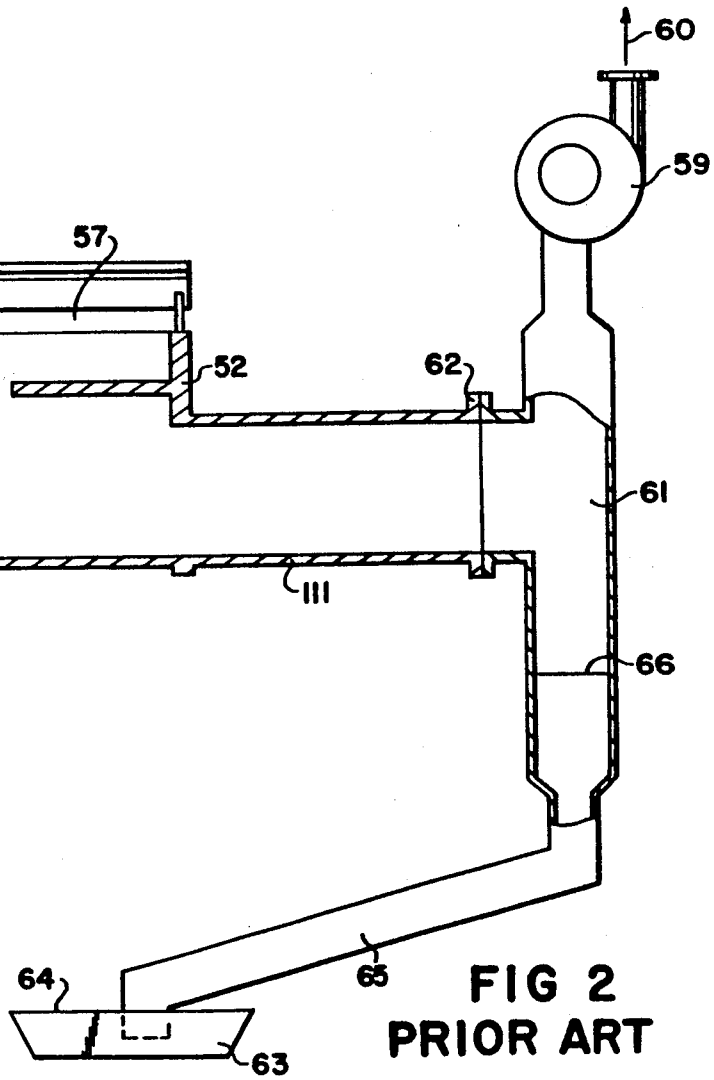
FIG 2 PRIOR ART
FIG. 2 is a front elevational view of a prior art drainage box in a Fourdrinier process
Figure 3:
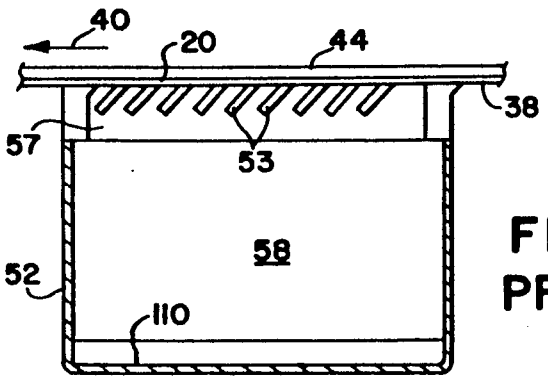
FIG 3 PRIOR ART
FIG. 3 is a cross sectional view taken at 3—3 of FIG. 2.

FIGS. 2-3 show one system of the prior art apparatus in which the standard drainage box 52 having an internal volume 58 and a plurality of parallel blades 53 in an assembly frame 57, with an open area of at least about 50%. The entire internal space 58 is not filled with water so that its upper surface is at the lower surface 38 of fabric 20 but is not in contact with the water in the aqueous dispersion 44 on top of fabric 20.

Thus, a known prior art system includes a conduit 111 expanding laterally out the end from a drainage box. A vertical standpipe 61 is placed at the end of conduit 111 through flange connection 62 to receive the air and water passed thereinto. At the upper end of standpipe 61 is a suction fan 59 blowing air outwardly in the direction of arrow 60 so as to create a vacuum in internal space 58. The lower portion of standpipe 61 serves as a hydraulic leg to seal the vacuum with water at level 66 draining through pipe 65 to a discharge below the water level 64 in a pond or collection vessel 63.

Figure 4:
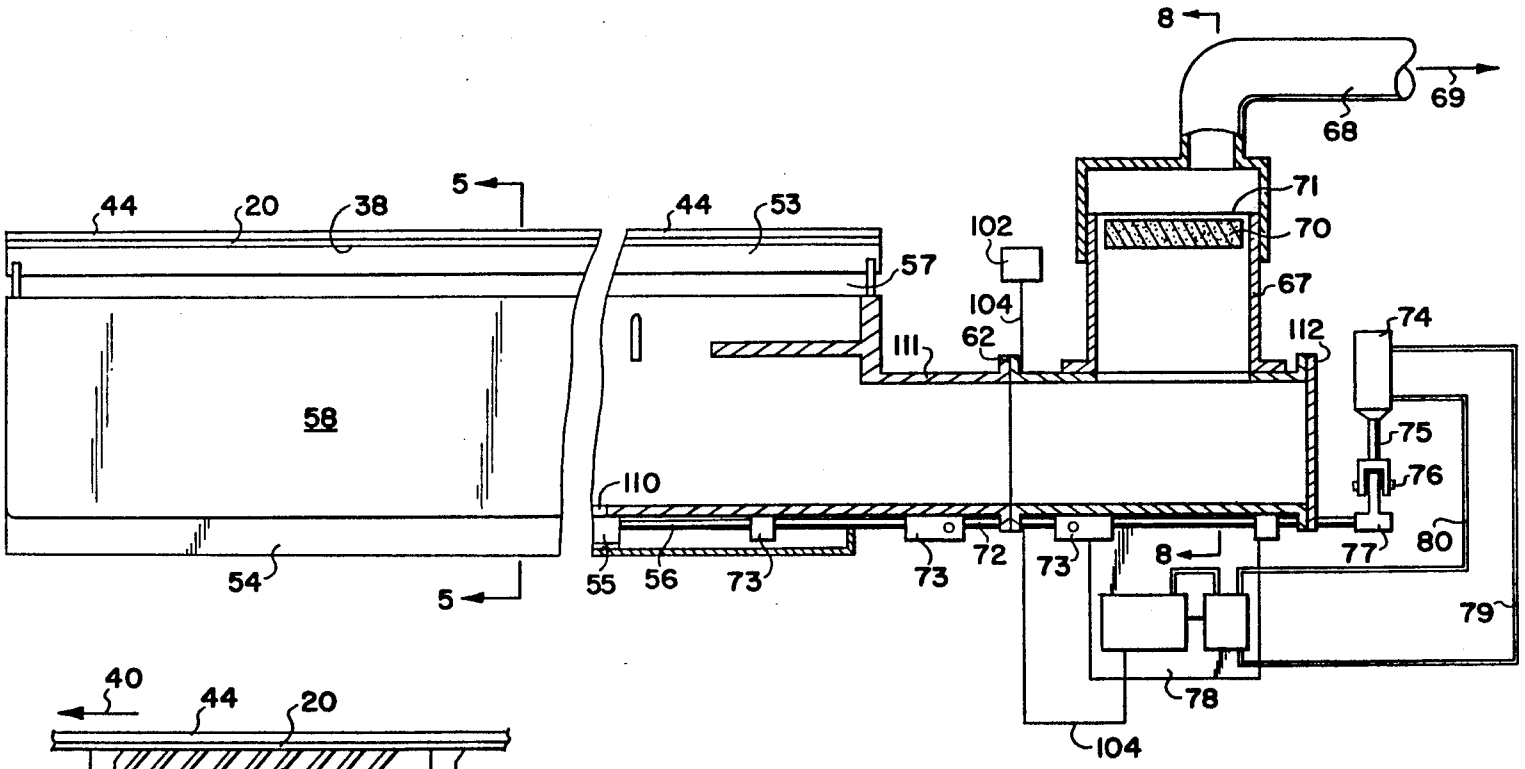
FIG. 4 is a front elevational view of a drainage box in a Fourdrinier process modified in accordance with a first embodiment of this invention, employing an automatic control.
Figure 5:
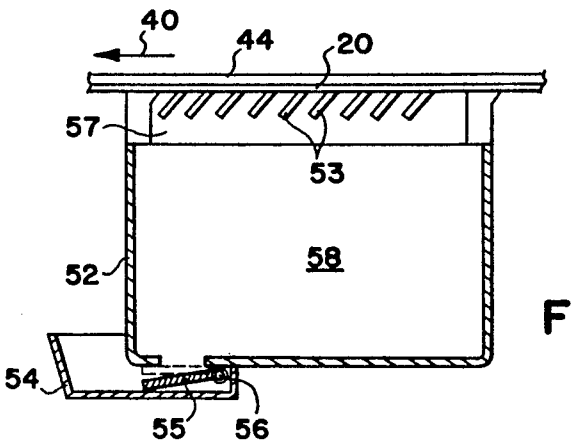
FIG. 5 is a cross sectional view taken at 5—5 of FIG. 4.

One preferred embodiment, in accord with this invention, is shown in FIGS. 4-5, and includes means to automatically control the water level in the dewatering meniscus tension unit 52 which in some respects are identical to that of the prior art described above, as its internal space 58, but blades 53 have, blade assembly frame 57, with an open area of at least about 90%, and tray 54, valve gate 55, and pivot pin 56 are added. However, an improved subassembly is attached to conduit 111 at flanges 62. A control tower 67 extends upwardly from conduit 111 and is filled with water to a level 71 which is slightly above the elevation of the inner or lower surface 38 of fabric 20. Above level 71 is a vacuum manifold 68 leading to a source of small vacuum, e.g., a fan, such as fan 59 in FIG. 2, with with reduced depression or suction power, with air flowing in the direction of arrow 69. In the Fourdrinier wire or fabric the tension of meniscus varies from about 15 to 20 cm of water column and a small vacuum on the volume of water below the fabric in accord with this invention will be in pretension of about 10 cm of water column so that dewatering is induced more readily. Cover plate 112 is provided as an access for cleaning conduit 111 and/or tower 67.

The float 70 is designed to be maintained at level 71, but it will move up and down, and the movement of float 70 is sensed by transducer 102 to control via electric line 104 an electric motor and fluid pump 78 which pumps the fluid through fluid lines 79 and 80 to and from actuator 74 causing connecting rod 75 to move. The linear movement of rod 75 is transmitted through clevis 76 and arm 77 to cause shaft 72 to rotate about its longitudinal axis, which in turn, causes valve gate 55 to open or close. Thus, the level of water at lower surface 38 is controlled so as to maintain it at that elevation while sucking as much water as rapidly as possible away through unit or box 52 and into tray 54 and out therefrom to produce a differential pressure effect, together with the modification of the natural tension of the meniscus of water attached to the interstices of the fabric 20.

Figure 6:
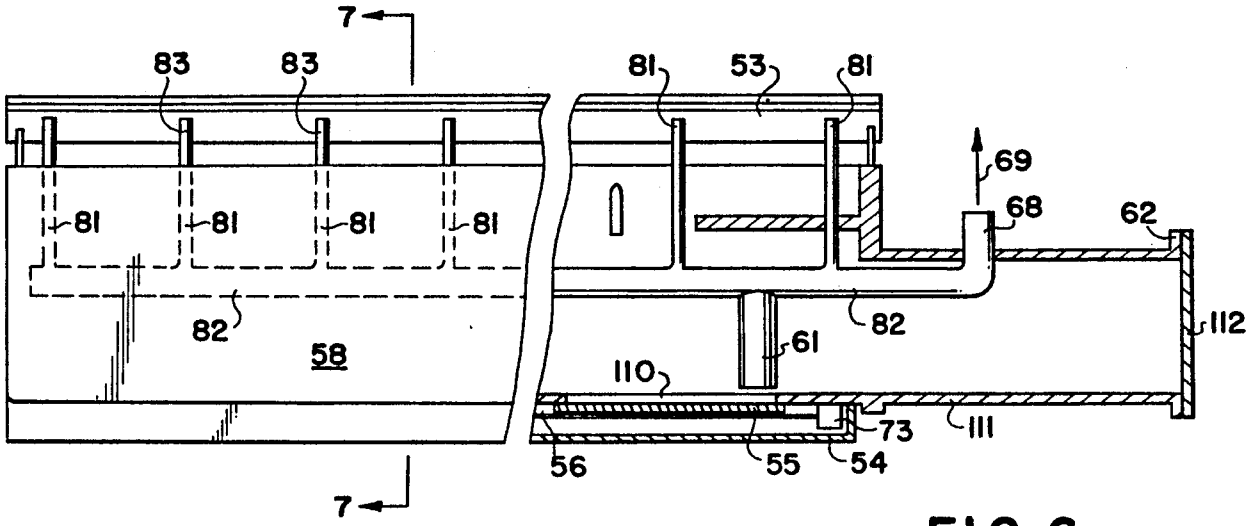
FIG. 6 is a front elevational view of a drainage box in a Fourdrinier process including a means for removing entrained air in accordance with a third embodiment of this invention.
Figure 7:
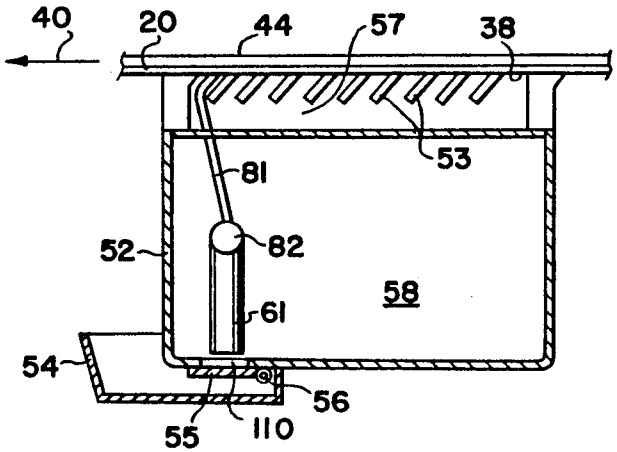
FIG. 7 is a cross-sectional view taken at 7—7 of FIG. 6.

Another embodiment of the invention is shown in FIGS. 6-7. Because of the imperfections involved in forming the fiber aqueous dispersion 44, placing it on fabric 20, and moving it through the process, there are pockets of entrained air found in dispersion 44 as it moves across drainage box 52. As noted above the presence of air is undesirable and the air should be removed as soon as possible so as to eliminate the formation of any air/water meniscus beneath fabric 20. In FIGS. 6-7, a means is provided to eliminate such formation and is seen to include a plurality of suction tubes 81 spaced apart from each other across the lateral width of fabric 20. The upper free ends 83 of tubes 81 are placed between adjacent blades 53, preferably at least the most downstream blades, and positioned at or very near to bottom surface 38 of fabric 20. Tubes 81 are connected to a manifold 82 which leads to a source of low vacuum through conduit 68 in which air flows in the direction of arrow 69. Tubes 81 will cause water as well as air to pass from adjacent the bottom of the fabric 20 with the water being separated to flow downward in hydraulic leg 61 to a discharge level such as the level of water in tray 54. As shown in FIG. 6 gate 55 and the passageway 110 are elongated in the direction of the longitudinal axis of the drainage box 52 to accommodate for a large amount of water being drained through the fabric 20 and the open area on top of box 52 between spaced blades 53, which open are is at least about 90% of the total top of box 52, as set forth above with respect to FIGS. 2 and 3.

Figure 10:
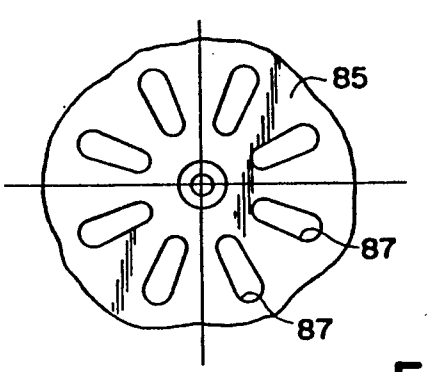
FIG. 10 is a cross sectional view taken at 10—10 of FIG. 8.
Figure 9:
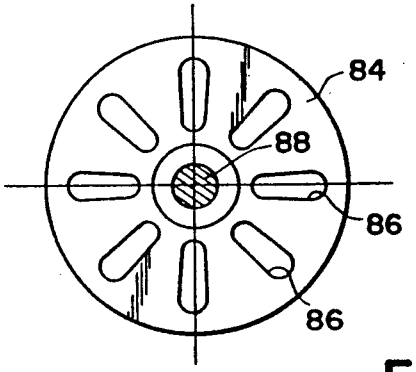
FIG. 9 is a cross sectional view taken at 9—9 of FIG. 8.
Figure 8:
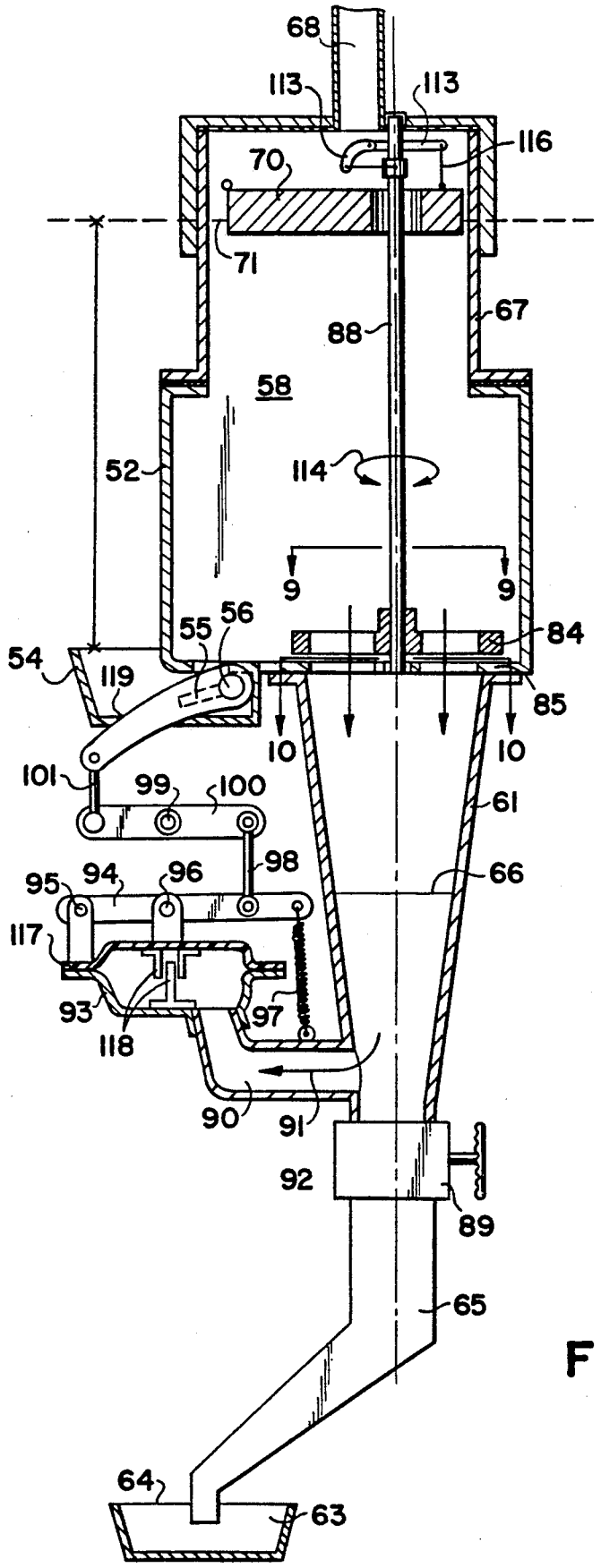
FIG. 8 is an enlarged cross-sectional view taken of a drainage box, similar to that taken at 8—8 of FIG. 4, but in considerably greater detail and with some modifications thereto.

In FIGS. 8-10 there is shown a mechanical apparatus for controlling the system such as that shown in FIGS. 4-5 and described generally hereabove. Control tower 67 is connected to internal space 58 in a drainage box 52 and is filled with water with a float 70 resting on the surface of the water and a vacuum line 68 leading off to a vacuum source (not shown), such as fan 59 of FIG. 2. As float 70 moves up and down because of water level 71 changing, lever linkages 113 connected to float 70 by connector 116, cause shaft 88 to rotate in the direction of arrow 114. At the lower end of shaft 88 is a valve plate 84 with openings 86 extending vertically through plate 84. Valve seat 85 also has complemental openings 87 therein, which generally match openings 86. When valve plate 84 is rotated, the openings 86 and 87 will partially or fully align to permit water in tower 67 to flow into drop leg 61 and when fully unaligned will not permit water to so flow. Water in drop leg 61 fills up to a level at 66 and may be drained away in either of two ways; namely, through side arm exit 90 or through valve 89 into pipe 65 and thence to pond or vessel 63 having a water level at 64. Valve 89 is a fine adjustment to divert the necessary water to side arm exit 90 and allow the remainder to fall into pond or vessel 63. Water from side arm exit 90 flows in the direction of arrow 91 into diaphragm valve 93 causing arm 96 to move up and down as the diaphragm 117 of valve 93 flexes. The diaphragm guide is illustrated by numeral 118. Spring 97 is biased to hold levers 94 and 98 down until water in diaphragm valve 93 causes it to move upward. The movement of arm 96 is transmitted through pivot 95 and lever 94 to leg 98 to lever 100 through pivot 99 to connector 101 which operates a lever 119 that is used to control the opening and closing or valve gate 55 in drainage tray 54 by pivoting about pin 56. Thus the movement of float 70 is transformed into a compensating opening or closing movement of valve gate 55. As the float 70 moves upward beyond the desired level, valve gate 55 automatically opens and vice versa so as to control and maintain constant the water level in the drainage box 52 at the fabric 20 which passes over the box 52.

Figure 11:
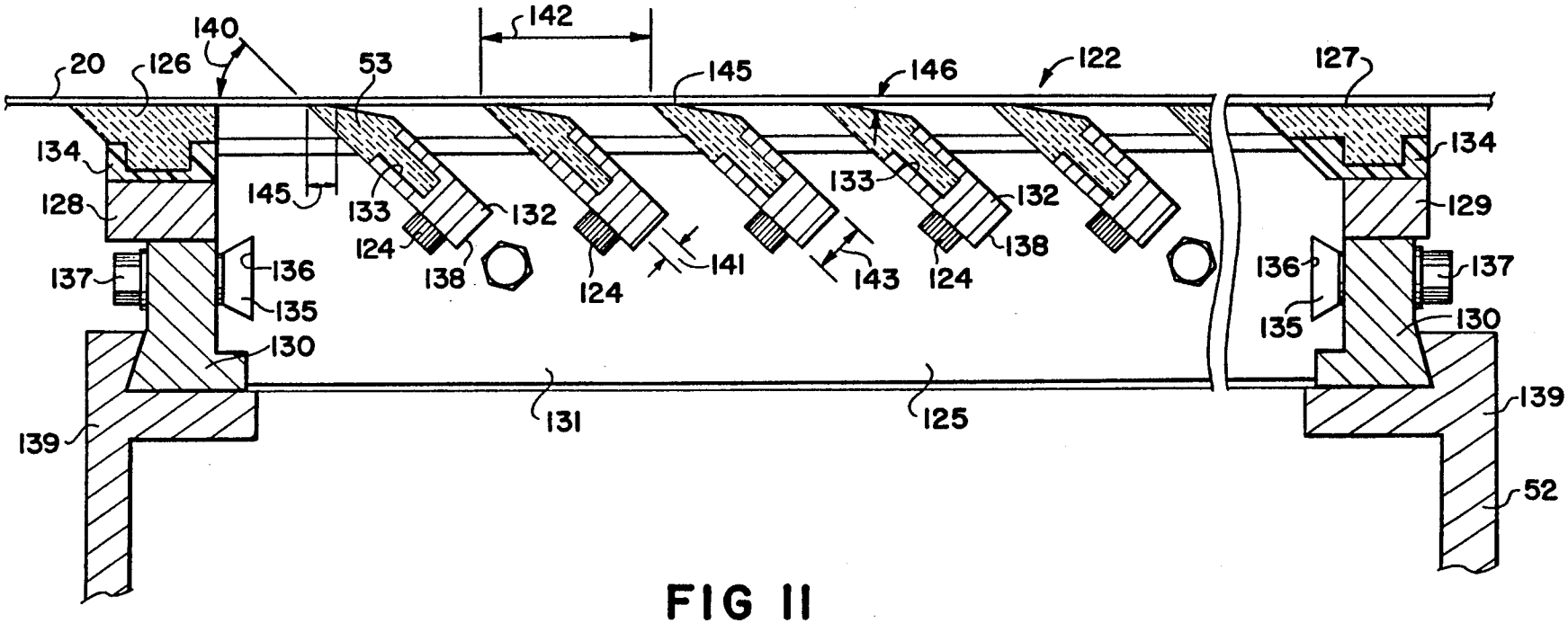
FIG. 11 is a cross sectional view of the improved drainage box cover, taken transversely to the running blades, and usable on each of the drainage boxes illustrated in FIGS. 3, 5 and 7.

The covers 122 for the submerged drainage dewatering meniscus tension units or boxes 52 of FIGS. 2-7 are shown in FIG. 11 and are generally disclosed in the U.S. patent application Ser. No. 07/326,384 filed Mar.

21, 1989, now U.S. Pat. No. 4,957,598, corresponding to Italian Patent Application No. 83354/A/88, filed Mar. 29, 1988 by Glauco Corbellini, and the subject matter thereof is incorporated herein by reference. Basically, the submerged drainage box cover assembly 125 includes a lead blade 126 and trailing blade 127 which are preferably ceramic and fixed to respective rigid parallel bases 128 and 129 and assembled over lateral beams 130. A rigid box beam support or plate 131 joins the lateral beams 130 into a unitary assembly 125. The assembly 125 provides a series of blade holders 132 whereby individual ceramic deflector blades 53 can be installed. Each blade 53 fits into a slot 133 and is glued together. The holder 132 is preferably a laminated fiberglass unit constructed of multiple layers of fiberglass cloth bonded with epoxy resin. The bonding material 134 is preferably ceramic to metal and such material attaches lead blade 126 and trailing blade 127 to respective bases 128 and 129 and reinforced with screws. Box support plates 131 are connected to lateral beams 130 via a threaded key 135 located in keyway 136 and bolt 137. The holders 132 are affixed in the stainless steel members 138 by the key 124. As seen, the cover assembly 125 is supported on frame 139 forming the side walls of the suction boxes 52.

The deflector mounting angle 140 preferably is between 35–60 degrees and this can be adjusted to obtain the desired drainage conditions for each of the drainage boxes 52. The contact nose surface 145 of each of blades 53 is normally between about 2–3 mm wide and gives an open area of about 90%. The divergence angle 146 is designed to be adjustable from about 5–15 degrees, depending on drainage conditions desired, even for the particular location of the drainage boxes 52 in the wetter end of the Fourdrinier. The blade holder slot thickness 141 can vary between about 3–4 mm and the blade spacing 142 can vary according to blade thickness 143, which is maintained between 6–9 mm, the desired open area and other physical dimensions of the assembly 125. The nose surface 145 of the blades 53, over which the fabric slides, includes an acute divergence angle 146, which has heretobefore not been disclosed in the above mentioned patent application nor the above open area or other preferred dimensions for the particular purposes of the herein disclosed system, and these are important in submerged drainage to minimize the contact with the fabric and to cause more water to be drained from the fabric as it is passing over the blades 53 offering an open area of at least about 90% with a deflector angle 140 of approximately 45°.

Figure 12:
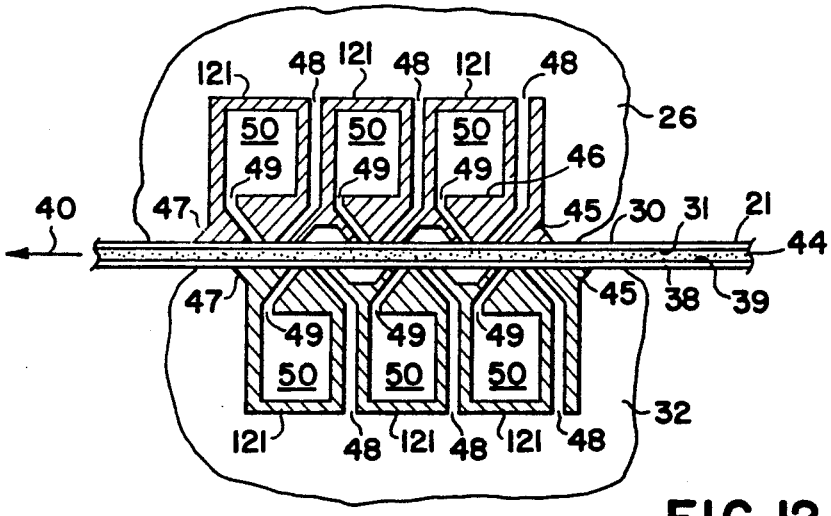
FIG. 12 is an enlarged cross-sectional view of the drainage box taken at 12—12 of FIG. 1.
Figure 13:
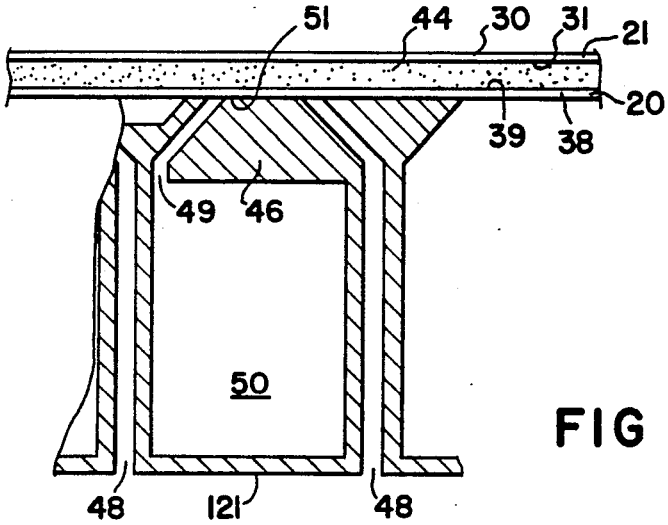
FIG. 13 is an enlarged cross-sectional view of a portion of the drainage box of that shown in FIG. 12.
Figure 14:
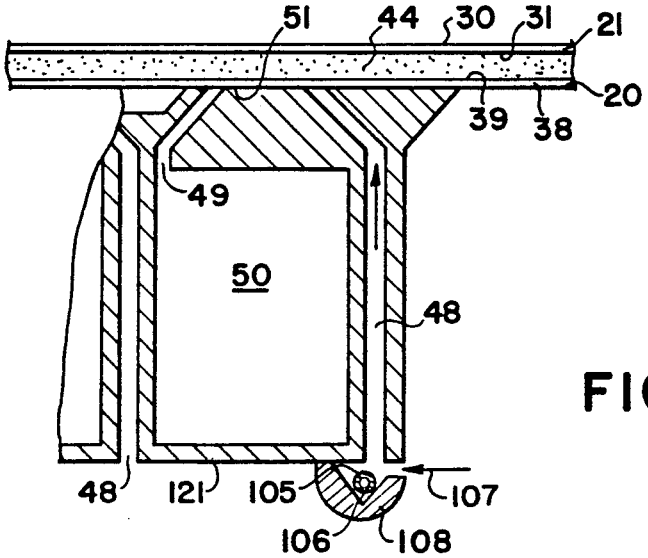
FIG. 14 is identical to FIG. 13, except to include an improvement in the air inlet portion.

FIGS. 12–14 show an improved design for a drainage box for the drier end of the Fourdrinier machine to be used in place of the high vacuum flat suction boxes of the prior art, and FIG. 1 shows a preferred arrangement for their use. As mentioned above the lower part of FIG. 1 is somewhat similar in many respects to the prior art Fourdrinier paper making system, but without the improved submerged drainage boxes, etc., set forth herein. FIG. 1 has combined an auxiliary Fourdrinier system in the drier end of the drainage area, which is somewhat generally known in the prior art, as shown for example, by U.S. Pat. No. 4,306,934, dated Dec. 22, 1981 invented by Erkki O. Seppanen. An upper Fourdrinier fabric 21 has an outer surface 31 in contact with the upper surface of the web 44', which has now formed by the prior dewatering operation acting on aqueous dispersion 44, so as to have fabric 20 below the web 44' and fabric 21 above the web 44'. Both fabrics 20 and 21 are horizontal with the dispersion 44 and web 44' supported on lower fabric 20 and both fabrics 20 and 21 are made to run in the same direction 40 where they are closely parallel to each other. Since each fabric 20 and 21 is separate and distinct and is an endless length, they must each be driven, guided, and tensioned by separate sets of rollers. Upper fabric 21 is driven through its course with its inner surface 30 in contact with drive roller 23, return roller 22, tension roller 24, and guide roller 25, and its outer surface 31 in contact with web 44'. A similar set of rollers is needed for fabric 20 although only drive couch roller 36, breast roller 120, and tension roller 37 are shown in contact with inner surface 38, while outer surface 39 is in contact with web 44'. In the wet end first portion of the process, only one fabric, namely lower fabric 20, is needed while the fiber/aqueous dispersion 44 is passed over a dewatering forming box or meniscus tension unit 41, a dewatering meniscus tension fiber locking unit or box 42, and a final drainage box 43, all being submerged drainage units boxes in accord with the invention hereinabove set forth. In the remainder of the web formation portion of the process there are upper submerged drainage dewatering wire meniscus separate or multicell units or boxes 26, 27, 28 and 29 and lower submerged drainage boxes multicell units or 32, 33, 34 and 35. Upper fabric 21 is in contact with upper drainage boxes 26, 27, 28 and 29, while lower fabric 20 is in contact with lower drainage boxes 32, 33, 34 and 35. Thus, a paper web is discharged from between the Fourdrinier fabrics 20 and 21 in which the sides of the paper are substantially identical.

Both upper and lower submerged drainage separator multicell units or boxes are made of a plurality of drainage cells 121 as shown in FIGS. 12–14. Each cell is constructed generally as shown in FIG. 13 having a central vacuum chamber 50 maintained at subatmospheric pressure, a nose 51 in sliding contact with the inside surface (38 of fabric 20 or 30 of fabric 21) with inclined passageways 48 and 49 leading toward and away from nose 51. Three such cells are shown in FIG. 12 extending laterally across fabrics 20 and 21 in generally the same fashion as blades 53 in FIGS. 2–7, and 11. One end of each vacuum chamber 50 is opened into an individual conduit like conduit 111 of FIG. 2 or into a manifold (not shown) which is then attached to a conduit, like conduit 111, where the air and water is separated by reason of water falling into the water in standpipe 61 and being drained away into pond or vessel 63 while the air is blown away through fan 59. The other end of vacuum chamber 50 is closed so as to force all air and water into conduit 111. As air and water is sucked through passageway 49 into chamber 50, air from the surrounding atmosphere flows into passageway 48 to pass over nose 51 and through the interstices in the thickness of the fabric 20 below or the fabric 21 above. So long as water is being sucked from the fabric 20 and 21 the meniscus of water in the wire or fabric 20 is eliminated the surface of the web 44' in contact with each fabric 20 and 21 transfers the water therefrom to the respective fabric 20 and 21, repeating the action until the energy of meniscus in the web is unable to extract residual water from the web itself. The vacuum that is needed for this operation is low and only about 3 inches of Hg. generally for most fabric speeds, but this is sufficient to permit drainage boxes multicell separator units or 26, 27, 28 an 29 to even function upside down on upper fabric 21. This is in sharp contrast to the high vacuum of the prior art which may be at about 5–12 inches of Hg. Also, an appropriate discharge from one end of each of the boxes or cells 121 is provided to discharge the water therefrom in any well-known manner such as illustrated in FIG. 2. The combination of three rows of cells as shown in FIG. 12 includes a lead deflector surface 45, intermediate deflectors 46, and trailing deflector surface 47, all being stationary surfaces over which the moving fabric 20 or fabric 21 travels. Such surfaces are needed to support the fabric 20 and 21 in a smooth stable manner. In one improved embodiment as shown in FIG. 14 pipe 105 carrying steam to spray downwardly out at 106 into passageway 48 enhances the operation by heating the air passage through passageway 48 and thereby heating the water in web 44 causing its viscosity to be lowered and thereby making it flow more rapidly through fabric 20 or 21. An insulated reflector 108 is shown to protect against loss of the heat before it is sprayed at 106. The entrance of air into passageway 48 is permitted by opening 107 through reflector 108.

As shown in FIG. 12, the upper drainage boxes or multicell wire meniscus drainage units are horizontally offset from the lower drainage boxes so that a vacuum is not applied to each side of the paper web at the same time at a particular location. If this were not so, it is likely that air may occasionally pass through and damage the paper web. Also, the spacing or tolerance between the upper and lower fabrics might cause damage thereto on account of entrained debris in the web and to inhibit such damage the water is not withdrawn from the web simultaneously vertically at any particular location spaced along the two fabrics.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A submerged drainage system in combination with and for removing water from a moving single horizontal Fourdrinier fabric having a drier end downstream of a wetter end, an outer surface, and an inner surface in a paper making process, said system comprising a first plurality of spaced elongated stationary dewatering meniscus tension units each having a housing with a bottom and an upper drainage surface in continuous sliding contact with said inner surface of said fabric and an aqueous dispersion of paper making fibers supported on said outer surface of said fabric and saturating said fabric through and to said inner surface, said first dewatering meniscus tension units being located below and spaced along the wetter end of said fabric, each said first dewatering meniscus tension unit having an internal space containing a large volume of water extending to and maintained continuously in contact with said inner surface of said fabric to inhibit passage of air through said aqueous dispersion and formation of a water-to-air meniscus in said horizontal fabric, a plurality of passageways from said drainage surface to said internal space of said first dewatering meniscus tension unit to conduct water from said outer surface to said inner surface of said fabric and into said internal space, a first elongated passageway extending through said housing adjacent said bottom and located generally transverse and generally coextensive with said fabric for conducting a large amount of water outwardly from said internal space and below said fabric, control means for each said first dewatering meniscus tension unit structured and arranged to control the level of the large volume of water in said internal space of said first dewatering meniscus tension unit and to maintain a constant level of water in continuous contact with said inner surface of said fabric to inhibit formation of a water-to-air meniscus in said fabric, said control means including valve means at said first passageway for controlling the volume of water passing through said fit passageway, and means for applying a small vacuum to said internal space of each said first dewatering meniscus tension unit and the large volume of water therein which modifies the natural tension of meniscus of water to induce drainage of a large amount of water through said fabric from said aqueous dispersion.

2. The system of claim 1 wherein said means for applying a small vacuum includes a small vertical head of water in fluid contact with said large volume of water in said internal spa e, said vertical head of water having an upper surface interfacing with air under subatmospheric pressure so as to apply a small vacuum to the large volume of water.

3. The system of claim 2 wherein said control means includes a float on said surface of said vertical head of water, and means to sense the position of said float and correspondingly to move said valve means to open or close same in accordance with said position so sensed.

4. The system of claim 1 wherein each said first dewatering meniscus tension unit includes a plurality of spaced parallel blades with upper and lower lengthwise edges forming said plurality of passageways, said upper edges being a forward area of contact with said fabric and being relieved adjacent its rearward area and forming a divergence angle of 5° to 15° from a plane formed by said forward areas, said blades being spaced upwardly from said bottom and above said internal space.

5. The system of claim 4 wherein the width of each blade as measured along said fabric is between 6–90 mm, said forward area as measured along said fabric being between 2–3 mm, said blades being spaced apart a redetermined distance between 25–40 mm as measured between most forward ends of adjacent blades to provide an open area of about 90%.

6. The system of claim 1 wherein said control means to control the level of water includes sensing means to detect any rise or fall of the level of water in each said first dewatering meniscus tension unit, and power means between said sensing means and said valve means to move said valve means dependent on the detected rise or fall of the level of wear in each said housing to maintain a constant level of water in said internal space.

7. The system of claim 1 further comprising a water tray communication with said first passageway outwardly of said housing in which the level of water therein said above said bottom of said housing.

8. The system of claim 7 wherein said valve means is located between said first passageway and said water tray.

9. The system of claim 7 wherein said control means includes a water toward communicating with said internal space and a movable float therein, said tower extending upwardly adjacent a side edge of said fabric, said float controlling the opening and closing of said valve means which is located between said first passageway and said water tray to control the amount of fluid flow from said internal space into said tray whereby the differential pressure of the water spilling out of said tray outwardly of said dewatering meniscus tension unit is controlled by water meniscus in pretension.

10. The system of claim 9 wherein said means for applying a small vacuum includes a conduit communicating with said water tower above said movable float.

11. A submerged drainage system for removing water from a moving horizontal Fourdrinier fabric having a drier end downstream of a wetter end, an outer surface, and an inner surface in a paper making process, said system comprising a first plurality of spaced elongated stationary dewatering meniscus tension units each having a housing with a bottom and an upper drainage surface in continuous sliding contact with said inner surface of said fabric and an aqueous dispersion of paper making fibers supported on said outer surface of said fabric and saturating said fabric through and to said inner surface, said first dewatering meniscus tension units being located below and spaced along the wetter end of said fabric, each said first dewatering meniscus tension unit having an internal space containing a large volume of water extending to and maintained continuously in contact with said inner surface of said fabric to inhibit passage of air through said aqueous dispersion and formation of a water-to-air meniscus in said horizontal fabric, a plurality of passageways from said drainage surface to said internal space of said first dewatering meniscus tension unit to conduct water from said outer surface to said inner surface of said fabric and into said internal space, a first passageway adjacent said bottom for conducting a large amount of water outwardly from said internal space, control means or each said first dewatering meniscus tension unit structured and arranged to control the level of the large volume of water in said internal space of said first dewatering meniscus tension unit and to maintain a constant level of water in continuous contact with sad inner surface of said fabric to inhibit formation of a water-to-air meniscus in said fabric, means for applying a small vacuum to said internal space of each said first dewatering meniscus tension unit and the large volume of water therein which modifies the natural extension of meniscus of water to induce drainage of a large amount of water through said fabric from said aqueous dispersion, said control means including an exit valve cooperating with said first passageway for adjusting the flow of water from said internal space in each said first dewatering meniscuses tension unit, and a first conduit containing a vertical column of water having an upper surface which does not conform in elevation to the upper surface of water in said dewatering meniscus tension unit being controlled, a float in said first conduit at said upper surface of said column of wear, a first adjustable valve means attached to said first conduit for selectively releasing water from said first conduit as said upper surface of said column of water falls, a second conduit vertically below said valve means and having a discharge end below a level of water in a container open to atmosphere, second adjustable valve means in said second conduit above said discharge end to control the flow of water therethrough, a side exit conduit connected to said second conduit between said first and second valve means, a diaphragm, valve means for translating water pressure therein to a mechanical movement, said diaphragm valve means including a diaphragm, lever means connected between said diaphragm and said exit valve to transmit movement thereof to control the movement of said exit valve in said dewatering meniscus tension unit.

12. A submerged drainage system for removing water from a moving horizontal Fourdrinier fabric having a drier end downstream of a wetter end, an outer surface, and an inner surface in a paper making process, said system comprising a first plurality of spaced elongated stationary dewatering meniscus tension units each having a bottom and an upper drainage surface in continuous sliding contact with said inner surface of said fabric and an aqueous dispersion of paper making fibers supported on said outer surface of said fabric and saturating said fabric through and to said inner surface, said first dewatering meniscus tension units being spaced along the wetter end of said fabric, each said first dewatering meniscus tension units having an internal space containing a large volume of water extending to and maintained continuously in contact with said inner surface of said fabric to inhibit formation of a water-to-air meniscus thereat, a plurality of passageways from said drainage surface to said internal space of said first dewatering meniscus tension unit to conduct water form said outer surface to said inner surface of said fabric and into said internal space, a first passageway for conducting a large amount of water outwardly from said internal space, a plurality of elongated air suction tubes spaced apart across the lateral width of said fabric with an open upper end positioned near said inner surface of said fabric, means for applying a small vacuum to said tubes and said internal space of each said first dewatering meniscus tension unit and the large volume of water therein which modifies the natural tension of meniscus after to induce drainage of a large amount of water through said fabric from said aqueous dispersion, a water tray having an upper edge above said bottom of said unit and communicating with said first passageway to discharge water delivered therethrough into said tray and thence spilled outwardly therefrom to create a differential pressure through said first passageway and into said internal space of each said first dewatering meniscus tension unit, a second passageway including a portion remote from said upper ends of said tubes for discharging any water after entrained with air being passed through said tubes into the water adjacent said bottom of said first dewatering meniscus tension unit below the minimum level of water established in said first dewatering meniscus tension unit by said tray.

13. The system of claim 12 wherein said means for applying a small vacuum includes a single elongated conduit extending generally along the length of said unit and being connected to said tubes along its length, said means for applying a small vacuum, being connected to a lower end portion of each said tube, said portion of said second passageway being at least one conduit attached to said elongated conduit and having a free end extending below the minimum level of water established in said unit by said tray.

* * * * *